United States Patent [19]

Koshoffer et al.

[11] 4,259,842

[45] Apr. 7, 1981

[54] COMBUSTOR LINER SLOT WITH COOLED PROPS

[75] Inventors: John M. Koshoffer, Cincinnati; Edward E. Ekstedt, Montgomery; Edward I. Stamm, Cincinnati, all of Ohio

[73] Assignee: General Electric Company, Cincinnati, Ohio

[21] Appl. No.: 967,928

[22] Filed: Dec. 11, 1978

[51] Int. Cl.[3] ..... F02C 7/12

[52] U.S. Cl. ..... 60/757

[58] Field of Search ..... 60/39.66, 39.65, 757, 60/755, 756

[56] References Cited

U.S. PATENT DOCUMENTS

| | | | |
|---|---|---|---|
| 3,572,031 | 3/1971 | Szetela | 60/39.66 X |
| 3,826,082 | 7/1974 | Smuland et al. | 60/39.66 X |
| 3,978,662 | 9/1976 | DuBell et al. | 60/39.66 X |
| 4,050,241 | 9/1977 | DuBell | 60/39.66 |
| 4,064,300 | 12/1977 | Bhangu | 60/39.66 X |
| 4,077,205 | 3/1978 | Pane et al. | 60/39.66 X |

*Primary Examiner*—Carlton R. Croyle
*Assistant Examiner*—Edward Look
*Attorney, Agent, or Firm*—Dana F. Bigelow; Patrick M. Hogan; Derek P. Lawrence

[57] ABSTRACT

A plurality of circumferentially spaced props are attached to the outer overlapping segments of a combustor liner to prevent the thermal outward growth of the inner segment. Placement of the props on the outer segment allows them to remain relatively cool to thereby minimize stresses and, when combined with a liner design which centrifuges the cooling air to the radially inner side of the cooling slot, such placement coincides with a separation bubble so as to minimize flow blockage and resulting hot streaks.

1 Claim, 5 Drawing Figures

COMBUSTOR LINER SLOT WITH COOLED PROPS

BACKGROUND OF THE INVENTION

This invention relates generally to combustion chambers and, more particularly, to means for effectively cooling the liners thereof. Although the present invention will be described in terms of a combustion chamber for use in gas turbine engines, it will be understood that the structure as contemplated is suitable for any high temperature combustion apparatus requiring film convection cooling.

Increased efficiency in gas turbine engines is accomplished, in part, by an increase of the operating temperature in the combustor. However, in order to withstand these high temperatures with an acceptable life term, it is necessary not only to employ highly sophisticated alloys and materials, but to provide an efficient and reliable means for cooling the liners of the combustion chambers.

One of the most efficient techniques for cooling the combustor liner is that of film convection cooling wherein a protective film boundary of cool air is made to flow along the inner surface of a liner so as to insulate the liner from the adjacent hot gases of combustion. The cooling air film not only forms a protective barrier between the liner and the hot gases, but also provides for convective cooling of the liner.

Introduction of the cooling air into the combustion liner is generally accomplished by way of a plurality of circumferentially spaced holes which provide fluid communication from a surrounding cooling air plenum to a plurality of axially spaced annular lipped pockets in the inner side of the liner. As cooling air enters the holes, it tends to mix and coalesce within the pocket. The air is then directed by the lip to flow rearwardly so as to attach to and flow along the inner surface of the liner.

It will be recognized that in order for the lip to provide the required directing function to the flow of air, it is necessarily cantilevered rearwardly a substantial distance so as to define with the outer liner surface, a slot for controlling the discharge of the thin film of cooling air. In order to prevent this slot from partial closing by the thermal outward growth of the lip, it has become common practice to provide small dimples or props in circumferentially spaced relationship around the lip to prevent the buckling tendency induced by the thermal stresses. While the inclusion of dimples in this manner serves well to overcome lip distortion, the dimples have been found to create wakes in the film of cooling air discharged along the inner surface of the liner. The wakes tend to destroy the uniformity of the cooling air barrier and permit hot gases of combustion to directly contact the inner liner of the combustor to thereby reduce its operating life.

U.S. Pat. Nos. 3,826,082 and 4,050,241, issued on July 30, 1974, and Sept. 27, 1977, and assigned to the assignee of the present invention, describe specific dimple construction for the elimination of the problems associated with the use of dimples, as described hereinabove. Although the solutions as proposed have, to a great degree, been successful, the dimples or props are still exposed to very hot temperatures and resultant high stresses which lead to short life of the dimples or props themselves. Further, even though the dimples are designed so as not to disrupt the flow of cooling air through the slot, they still tend to provide some restriction with resultant local wakes and hot streaking.

A combustor liner design which has to some extent overcome the difficulties as described hereinabove, is that shown in U.S. Pat. No. 3,978,662, issued on Sept. 7, 1976, and assigned to the assignee of the present invention. One feature of that design was a modified lip design which, because of its shorter length, tends to be less susceptible to thermal buckling. However, it should be recognized that the lip is still located in the hot gas stream and is subject to both high thermal stresses and thermal buckling, which would tend to close the gap and thus create disruptions in the cooling airflow.

It is, therefore, an object of the present invention to provide a combustor liner design with improved performance characteristics.

Another object of the present invention is the provision in a combustor liner film cooling slot for the prevention of a partial closing of the slot by thermal growth of the associated lip.

Yet another object of the present invention is the provision in a combustor liner cooling slot for the substantial elimination of hot streaking downstream thereof.

Still another object of the present invention is the provision in a liner cooling slot for a plurality of props which are not susceptible to high stresses and thus limited life resulting from exposure to high temperature gases.

Yet another object of the present invention is the provision for a combustor cooling liner which is effective in use and economical to manufacture.

These objects and other features and advantages become more readily apparent upon reference to the following description when taken in conjunction with the appended drawings.

SUMMARY OF THE INVENTION

Briefly, in accordance with one aspect of the invention, the props which are inserted for preventing the closing of the slot, are attached to the outer overlapping segment of the combustor liner where they are not exposed to the high temperature gases adjacent the inner lip. In this way, the props are effective for preventing the inner lip from growing radially outward to close the gap, but are shielded from the high temperature gases by the flow of the cooling air as it passes through the slot.

By another aspect of the invention, the annular enlargements which serve to collect the cooling air from the outer plenum, have a plurality of holes formed on the downstream side thereof and have at their rearward ends an annular form which when receiving the rearward flow of air from the holes in the rear side of the enlargement, tends to centrifuge the cooling air toward the radially inner side as it passes through the cooling slot. Thus, there is a point of reduced relative velocity, or a bubble, formed at the radially outer portion of the cooling slot the liner wall downstream. The present invention takes advantage of this bubble by placing the plurality of props in that position where they will not substantially disrupt the flow of the cooling air as it passes through the slot.

By yet another aspect of the invention, the downstream end of the props are tapered to decreasing radial height such that as the cooling air commences to flow radially to reattach to the liner wall, it may flow smoothly over the props without disruption.

In the drawings, as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
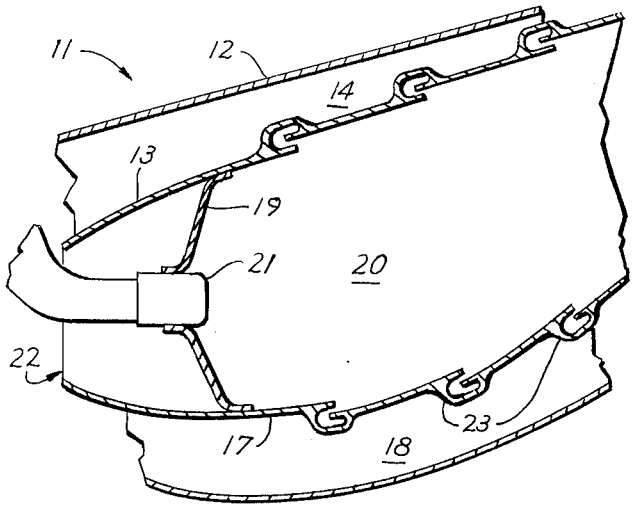
FIG. 1 is a partial cross-sectional view of a combustor chamber to which the present invention is applicable.

Referring to FIG. 1, a combustor chamber is shown generally at 11 and comprises an outer wall 12 and a generally parallel extending outer liner 13 to define a cooling air plenum 14 for receiving a flow of cooling air from the compressor bleed source (not shown) upstream. Similarly, an inner wall 16 and an inner liner 17 define a cooling fluid plenum 18. Liners 13 and 17, together with a dome 19, define a combustion zone 20 into which atomized fuel is injected by way of a fuel nozzle 21 and air entry passage 22. The fuel-air mixture is ignited and the resulting hot gases are discharged at the downstream end of the combustor to provide thermal energy to a turbine in a manner well known in the art.

It will be understood that, in order to maintain structural integrity while containing the extremely hot gases in the combustion zone 20, a plurality of axially spaced annular enlargements 23 are provided on the outer and inner liners 13 and 17 to inject cooling air into the liner from the cooling air plenums 14 and 18, respectively. The cooling air is made to flow along the inner surface of the liners to bring about a cooling function by way of surface and convection cooling.

Figure 2:
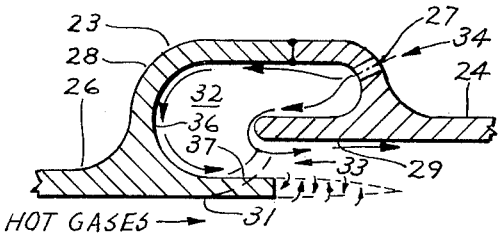
FIG. 2 is an axial cross-sectional view of a cooling slot portion thereof.
Figure 3:
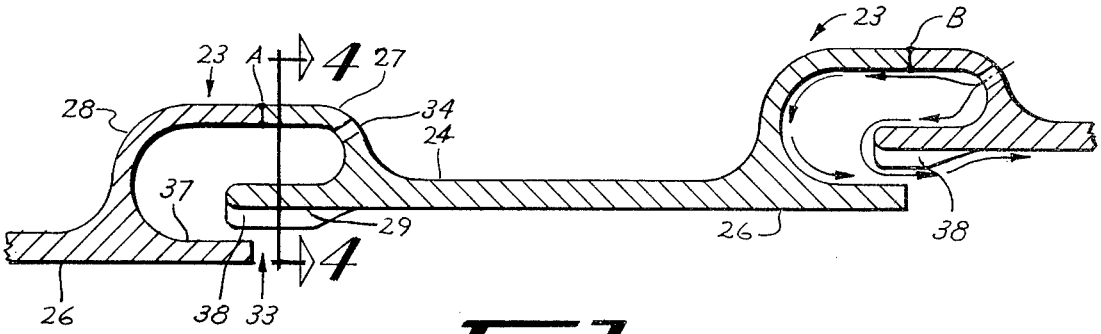
FIG. 3 is a longitudinal sectional view of a liner segment in combination with adjacent segments to form slots in accordance with the preferred embodiment of the invention.

Referring now to FIGS. 2 and 3, an enlargement is shown as rigidly connecting the outer surfaces of telescoping outer and inner liner segments 24 and 26, respectively. The annular enlargement 23 comprises curvilinear downstream and upstream ends 27 and 28, respectively, which, together with the upstream end 29 of the outer segment 24 and the downstream end 31 of the inner segment 26 defines an annular chamber 32.

The outer liner segment upstream end 29 and the inner liner segment downstream end 31 have overlapping portions which define an annular gap 33 which receives a supply of cooling air from the annular chamber 32 and passes it through a flow along the inner surface of the outer segment 24.

The enlargement downstream portion 27 combines with the outer segment upstream end 29 to define a generally U-shaped cross section for receiving cooling air by way of a plurality of circumferentially spaced holes 34, as indicated by the arrows in FIG. 2. Similarly, the enlargement upstream portion 28 combines with the inner segment downstream end 31 to define a generally U-shaped cross section with a curvilinear surface 36 transitioning to a generally axially aligned planar surface 37 as it approaches the annular slot 33. Thus, the cooling air enters the plurality of holes 34, coalescing as it passes through the chamber 32 and, as it changes direction by the surface 36, is centrifuged to the radially inner side of the slot 33 to pass close to the planar surface 37 before it then migrates radially outwardly to reattach to the inner surface of the outer segment 24. The terms "radially inner" and "radially outer" are used in reference to radial positions from a longitudinal axis extending through the center of the combustion chamber 11. It will be seen from the lines of flow that an area of reduced relative velocity, or a "bubble," which can include an area of airflow separation is created in the radially outer portion of the annular slot 33, but is not detrimental to the cooling function because the flow around the outer segment upstream end 29 still insulates that portion and the cooling airflow tends to flow around the bubble and reattach to the outer segment 24 as it flows downstream.

It will be recognized that the inner segment downstream end 31, or the "lip" as it is commonly called, is directly exposed to the hot gases passing along its inner surface. The lip 31 thus tends to grow thermally outward, as indicated by the dotted lines, and since the outer segment upstream end 29 is maintained at a substantially cooler temperature, the lip 31 tends to partially close the gap 33, as shown. In the extreme case, this causes a disruption of the cooling airflow and thereby results in hot streaking, high stresses and eventual failure.

Figure 4:
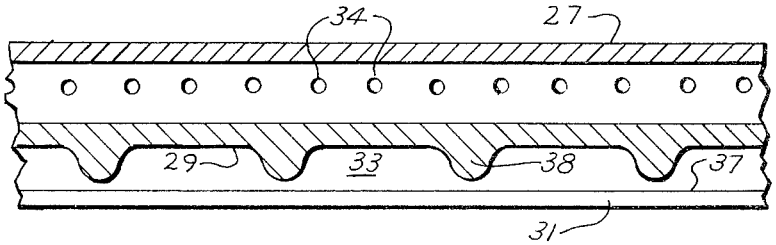
FIG. 4 is an axial sectional view, as seen along lines 4—4 of FIG. 3.

Referring now to FIGS. 3 and 4, a plurality of props 38 are attached, in circumferentially spaced relationship, to the inner side of the segment upstream end 29. The forward end of the prop 38 is in substantial axial alignment with that of the segment upstream end 29 such that a portion of the prop 38 is disposed in the annular slot 33. Thus, the props will act to restrict the radially outward thermal growth of the lip 31 such that even under the most extreme operating conditions, wherein the lip 31 comes to rest against the props 38, the annular slot will remain open in the area between adjacent props. The radially outer surface of the upstream end 29 of the outer liner segment 24 radially adjacent the props 38 presents a smooth surface to the flow of cooling air entering the chamber 32 through the holes 34 so as to not disrupt the airflow.

It should be recognized that the axial placement of the props is made to coincide with the axial position of the bubble. That is, unlike the placement of the prior art dimples, wherein their presence tended to disrupt the cooling airflow, the props are hidden in the bubble area so as not to substantially disrupt the flow. The props are elongated in the downstream direction and the trailing edge of the props are tapered to a downstream decreasing radial thickness such that the gradual outward transition and eventual attachment to the outer segment wall is facilitated. As can be seen in FIG. 3, the flow is then substantially the same as that for a liner without the props, except that the lip 31 is prevented from closing off the gap to disrupt the cooling airflow.

Figure 5:
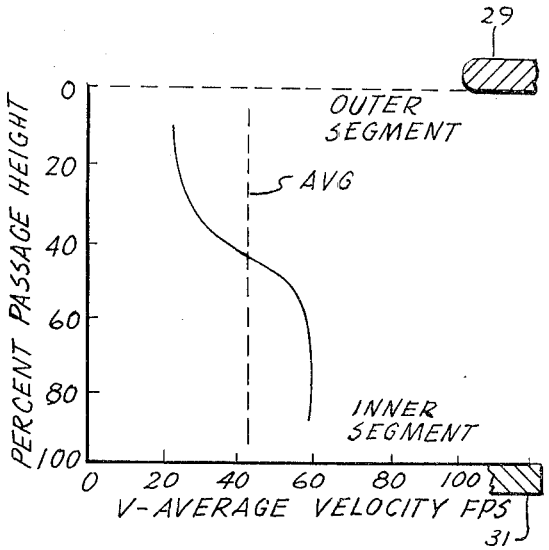
FIG. 5 is a graphic illustration of the cooling airflow velocity in relation to the slot radial position.

Returning now to the FIG. 2 embodiment without the props, and to the related flow characteristics of FIG. 5, a more detailed examination of the flow velocities within the radial profile of the cooling slot will provide a better understanding of the "bubble" into which the props are placed. FIG. 5 shows how the velocity of the cooling air varies across the radial expanse of the cooling air slot, between the outer and inner segments 29 and 31. It will be seen that there is a substantial variance in average velocity with respect to the radial position in the slot, with the highest velocity being near the inner segment and the lowest velocity being near the outer segment. Assuming that the radial thickness of the props 38 are such that they extend substantially half way across the annular slot 33, it will be seen that the velocity of the cooling airflow which it displaces will be generally below 50 ft per sec., whereas the velocity of the airflow in the area between the props and the lip 31 will be generally greater than 50 ft per sec for the case illustrated in FIG. 5. The actual velocities will vary depending on operating conditions, but the patterns will be as illustrated. The average velocity of the air in the cooling slot is substantially 40 ft per sec., whereas that in the radially inner portion of the slot is substantially higher. Thus, it will be seen that a cooling air slot, when used in combination with a centrifuging type of annular chamber 32, as shown, results in a velocity profile which is compatible with the placement of the props on the outer segment 29, as shown.

Referring back to FIG. 3, there is shown a pair of axially spaced enlargements 23 wherein the outer segment 24 is integral with and forms an extension of the inner segment 26 of the adjacent downstream enlargement 23. In this preferred embodiment, the combustor liner is made up of a plurality of segments which extend from point A to point B and which are secured at each end to substantially identical segments by way of welding or the like. It should be recognized that the specific construction and method of manufacture of the props 38 may vary while remaining within the scope of the invention. For example, they may be a simple dowel-like structure with associated fillets to present a streamline transition to the service of the outer wall 29. They may also be formed integrally with the outer wall 29 as by machining or rolling. Further, their dimensions and shape may be varied to accommodate a particular cooling flow characteristic.

We claim:

1. An improved combustor liner structure of the type having overlapping portions of telescoping outer and inner liner segments which together define an annular gap and means for transferring a cooling fluid from an outer plenum to flow through the annular gap for attachment to the inner surface of the outer liner segment downstream of said annular gap as a protective film barrier, wherein the improvement comprises:

(a) an annular enlargement section interconnecting the outer surfaces of said outer and inner liner segments and defining with the upstream end of said outer liner segment and the downstream end of said inner liner segment a chamber which fluidly communicates with the annular gap by way of a curvilinear surface adjacent the upstream end of said annular enlargement section;

(b) aperture means in the downstream side of said annular enlargement section for introducing the flow of cooling air into said chamber where it is then centrifuged radially inward by said curvilinear surface to pass through the radially inward side of said annular gap before attaching to the inner surface of the outer liner segment; and (c) a plurality of circumferentially spaced props attached to the inner surface of the upstream end of the outer liner segment and disposed in the radially outer side of said annular gap for thereby restricting the outward thermal growth of the downstream end of the inner liner segment, said props being elongated in the downstream direction and having tapered downstream ends for thereby facilitating attachment of said cooling air to said inner surface of said outer liner segment.

* * * * *